US006385916B1

(12) United States Patent
Marko

(10) Patent No.: US 6,385,916 B1
(45) Date of Patent: May 14, 2002

(54) HURRICANE REINFORCEMENT DEVICE

(75) Inventor: William Marko, West Palm Beach, FL (US)

(73) Assignee: Marko Doors & Gates, Inc., West Palm Beach, FL (US)

( * ) Notice: Subject to any disclaimer, the term of this patent is extended or adjusted under 35 U.S.C. 154(b) by 0 days.

(21) Appl. No.: 09/545,857

(22) Filed: Apr. 6, 2000

(51) Int. Cl.[7] ..... E04G 21/04

(52) U.S. Cl. ..... 52/127.2; 52/720.3; 52/736.1; 52/739.1; 52/DIG. 12; 160/201; 160/202

(58) Field of Search ..... 52/127.2, 146, 52/202, 301, 296, 720.3, 736.1, 739.1, DIG. 1, DIG. 12; 160/119, 201, 202, 209, 222

(56) References Cited

U.S. PATENT DOCUMENTS

| | | | | | |
|---|---|---|---|---|---|
| 3,708,917 | A | | 1/1973 | Streeter | 49/280 |
| 3,815,943 | A | | 6/1974 | Hass | 292/254 |
| 3,891,021 | A | | 6/1975 | Geoffrey | 160/234 |
| 4,208,970 | A | * | 6/1980 | Matyas | 410/153 |
| 4,574,860 | A | * | 3/1986 | Weiss | 160/118 |
| 4,996,795 | A | | 3/1991 | Maruyama et al. | 29/795 |
| 5,205,096 | A | | 4/1993 | Pace | 52/223.6 |
| 5,331,786 | A | | 7/1994 | Lippert | 52/731.1 |
| 5,337,520 | A | | 8/1994 | Uribe | 49/197 |
| 5,371,970 | A | | 12/1994 | Ganikon | 49/280 |
| 5,732,758 | A | * | 3/1998 | Marko | 160/201 |

* cited by examiner

*Primary Examiner*—Carl D. Friedman
*Assistant Examiner*—L. B. Porterie, Jr.
(74) *Attorney, Agent, or Firm*—McHale & Slavin

(57) ABSTRACT

A building aperture cover reinforcing device includes a support post having a first end spaced apart from a second end by a middle portion. Engagement pins extend from each end of the post, and linking hooks extend from the middle portion of the post. An upper anchoring assembly adapted for securement to an upper boundary wall of a building aperture selectively maintains the first engagement pin in a securing orientation, while the second engagement pin is selectively held in place by a lower anchor plate. The linking hooks engage corresponding linking plates disposed on the selected aperture cover. Each engagement pin includes bracing notches that engage corresponding edges of pin apertures located within the anchoring assembly and anchor plate, when the post shifts laterally. The bracing notches prevent vertical motion of the post during negative wind loads and positive wind loads.

4 Claims, 3 Drawing Sheets

HURRICANE REINFORCEMENT DEVICE

FIELD OF THE INVENTION

This invention is directed to storm reinforcement device and, in particular, to an easy-to-install and remove securement device especially suited for providing selective reinforcement of a garage door.

BACKGROUND OF THE INVENTION

Windstorms, such as hurricanes, place severe stresses on buildings which, if left unchecked, can lead to property damage and loss of life. Although these storms are relatively slow moving, the sustained, high-velocity winds they produce are often strong enough to remove roofs from building and destroy building walls. In many cases, even if the roof and walls of a building are sufficiently strong to resist the winds produced by a given storm, the building aperture covers, such as doors and windows, will fail. Many devices have been developed to protect building aperture covers against damage from windstorms.

Some building aperture covers may be sufficiently reinforced by sheets of plywood anchored against the aperture periphery. Corrugated panels of aluminum or other rigid materials, removably mounted on permanent tracks, are used in other situations. These types of reinforcement methods are suitable for relatively-small apertures. However, since these types of reinforcement panels do not collapse, they must be removed and stored when not in use. Weight and space requirements quickly become prohibitive factors as the size of the aperture to be covered increases. Panels sized to cover large windows or doors may be too heavy and cumbersome to move by a single person. The need for two-person installation severely limits the usefulness of this reinforcement method; a second person may not be available when a storm approaches, possibly preventing proper installation.

Folding, accordion-style panels are used as a way to address some of the liabilities of found in fixed-panel reinforcement methods. These typically require installation of one or more permanent guide tracks and are not suitable in all instances. For example, since accordion-style reinforcement devices are folded, not removed, during storage, sufficient space is required on either side of the covered aperture to accommodate the folded panels. Additionally, these types of reinforcing devices are often exposed to weather and require preventative maintenance to ensure that the stored panels will unfold easily and travel along the guide tracks when needed. Furthermore, folding-panel reinforcement devices are typically custom made, requiring specialized equipment and many hours of labor for production and installation. This tends to make folding panel reinforcements expensive. Even in situations where cost is not a factor, the characteristics of folding panel reinforcement devices makes them unsuitable for many large openings. For example, when used to reinforce large aperture covers, like garage doors, the folded panels may interfere with entry and exit when folded into a storage orientation. Although some settings are capable of accommodating the folded panels, the need to keep the panels secured to the building exterior may prove unsightly, making folding panel reinforcement devices unsuitable.

Other devices have been developed specifically to support garage doors. For example, U.S. Pat. Nos. 3,708,917; 3,815,943; 3,891,021; 4,996,795; 5,205,096; 5,331,786; 5,337,520; and 5,371,970; each disclose garage door supporting devices. However, these devices do not lower the stresses placed on the door mounting hardware and do not protect the reinforced door against damage from sustained wind loads. Additionally, these devices each requires skill during installation and may not be engaged by hand.

U.S. Pat. No. 5,732,758 allows hand engagement, but remains secured to a door even when not used. Although this arrangement is suitable for many settings, permanently attached reinforcement members add extra weight that may be undesirable in some cases.

Thus, what is needed is an aperture cover reinforcement device that includes advantages of the known devices, while addressing the shortcomings they exhibit. The reinforcement device should be simple to operate, being engageable by hand, without tools. The reinforcement device should also provide support against damage from both positive and negative wind loads. The reinforcement device should be removable for repair and lightweight enough for transport by a single person. The reinforcement device should also allow unhindered operation of the secured door when the device has been disengaged for storage.

SUMMARY OF THE INVENTION

The present invention is a reinforcement device suited for bracing a building aperture cover, such a garage door; the device is easy to install and remove. The device may be operated by one person without tools. The device employs an elongated support post having a first end spaced apart from a second end by a middle portion. An engagement pin extends from each end of the post. During use, the first end engagement pin is held in place by a bracket assembly attached to the building aperture upper boundary wall, and the second end engagement pin is held in place by a floor-mounted anchor plate. The post middle portion is secured to the aperture cover via cooperative interaction between linking hooks mounted along the post middle portion and corresponding linking plates mounted on the aperture cover.

More particularly, the bracket assembly includes a wall plate that is mounted to the aperture upper boundary wall, a spacer channel that extends outward orthogonally from the wall plate, and a pin engagement plate adjustably mounted on the spacer channel. The spacer channel includes a pin passthrough slot, and the pin engagement plate includes a pin passthrough aperture. The passthrough slot and aperture cooperatively facilitate insertion of the first engagement pin into the bracket assembly during use. Bracing notches disposed on the first end engagement pin engage corresponding pin passthrough aperture edges when the post shifts laterally, as when door reinforced by the present invention is subjected to wind loads. In this manner, the bracing notches prevent vertical motion of the support post during use.

The floor-mounted anchor plate includes a pin insertion aperture that accommodates the second end engagement pin. Bracing notches on the second end engagement pin engage corresponding edges of the pin insertion aperture when the post shifts laterally, as when door reinforced by the present invention is subjected to wind loads. In this manner, the bracing notches prevent vertical motion of the support post during use.

The middle portion of the post is removably secured to the reinforced garage door by S-shaped linking hooks disposed along a distal sidewall of the post. Each hook is contoured to engage a corresponding linking plate when the device is in a securing orientation.

During use, the first end engagement pin is inserted upward into the upper bracket assembly, until the post first end becomes seated against the bracket assembly. The post is then lowered, and the second end engagement pin is directed into the pin insertion aperture disposed in the lower anchor plate. As the second engagement pin is guided into the pin insertion aperture, the first end engagement pin travels downward with respect to the bracket assembly and the linking hooks engage the linking plates. As the post second end comes to rest on the lower anchor plate, the device assumes a securing orientation that prevents unwanted movement of the secured aperture cover.

Thus, it is an objective of the instant invention to provide a reinforcement device that is simple to operate, being engageable by hand, without tools.

Another objective of the instant invention is to provide a reinforcement device that provides support against damage from both positive and negative wind loads.

A further objective of the instant invention is to provide a reinforcement device that is removable for repair and lightweight enough for transport by a single person.

An additional objective of the instant invention is to provide a reinforcement device that allows unhindered operation of the secured door when the device has been disengaged for storage.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
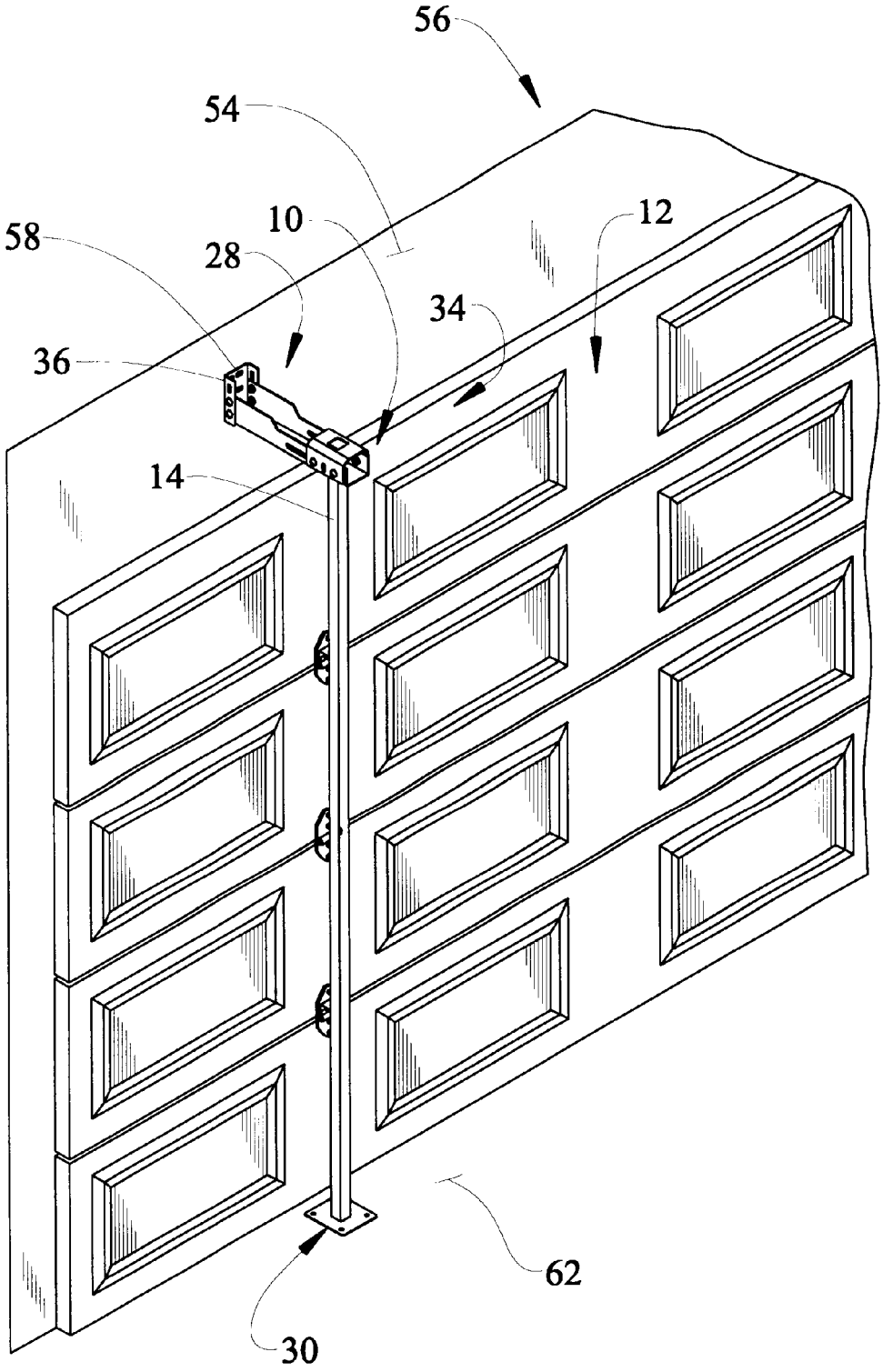
FIG. 1 is a pictorial view of the reinforcement device of the present invention, shown in a secured orientation.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Figure 1A:
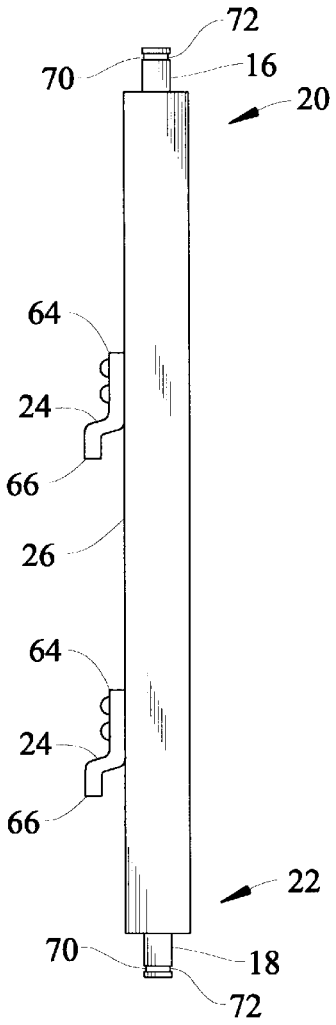
FIG. 1A is a pictorial view of the support post shown in FIG. 1.

With reference to FIG. 1, the reinforcement device 10 of the present invention is shown in use providing additional support to a building aperture cover 12, such as a garage door. By way of overview, and with additional reference to FIG. 1A, the reinforcement device 10 includes an elongated main post 14 having engagement pins 16,18 that extend from opposite ends 20,22 of the post, and linking hooks 24 that extend from a distal sidewall 26 thereof. During use, the first engagement pin 16 cooperates with a top anchoring bracket assembly 28; the second engagement pin 18 cooperates with a bottom anchor plate 30; and linking hooks 24 cooperate with linking plates 32, shown in FIGS. 3 and 5. With this arrangement, the engagement pins 16,18 and linking hooks 24 maintain the main post 14 in a securing orientation with respect to the building aperture 34 and the aperture cover 12. In this manner, the existing door-mounting hardware, not shown, need not support the entire magnitude of wind loads placed on the door 12; the engagement pins 16,18 transfer loads to the structure.

Figure 2:
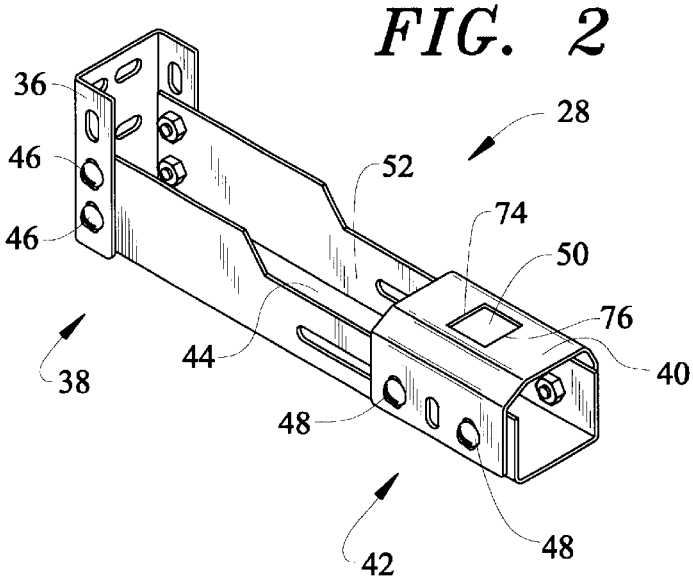
FIG. 2 is a close-up view of the first end securing means shown in FIG. 1.

Now with reference to FIGS. 2 and 2A, the top anchoring member 28 includes a bracket assembly having a wall connector plate 36 at a first end 38 spaced apart from a pin connector plate 40 at a second end 42 by a spacer channel 44 that extends therebetween. The wall connector plate 36 is essentially a C-sectioned channel adjustably attached to the spacer channel first end 38 via bolts, screws, or similar securement means 46, thereby allowing vertical adjustment of the spacer channel 44 with respect to the wall connector plate. It is noted that the wall connector plate 36 may be permanently attached to the spacer channel 44, if desired. The pin connector plate 40 is essentially a three-sided channel mounted in a horizontally-adjustable fashion on the spacer channel second end 42. The pin connector plate 40 is selectively secured in place on the spacer channel 44 via a bolt-and-nut arrangement or other similar securement means 48. The pin connector plate 40 includes a pin passthrough aperture 50 that aligns vertically with a pin passthrough slot 52 disposed within the spacer channel second end 42. With this arrangement, the pin passthrough aperture 50 and pin passthrough slot 52 cooperatively accommodate the first engagement pin 16 when the main post 14 is in the securing orientation, as described below. The top bracket assembly 28 is secured to the inside surface 54 of the downward-extending top wall 56 of the building aperture 34 by anchors or similar mounting means 58. It is noted that the top bracket assembly 28 may also be anchored into the garage ceiling, not shown.

Figure 4:
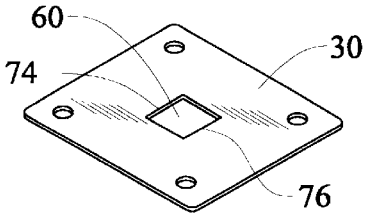
FIG. 4 is a close-up view of the second end securing means shown in FIG. 1.
Figure 5:
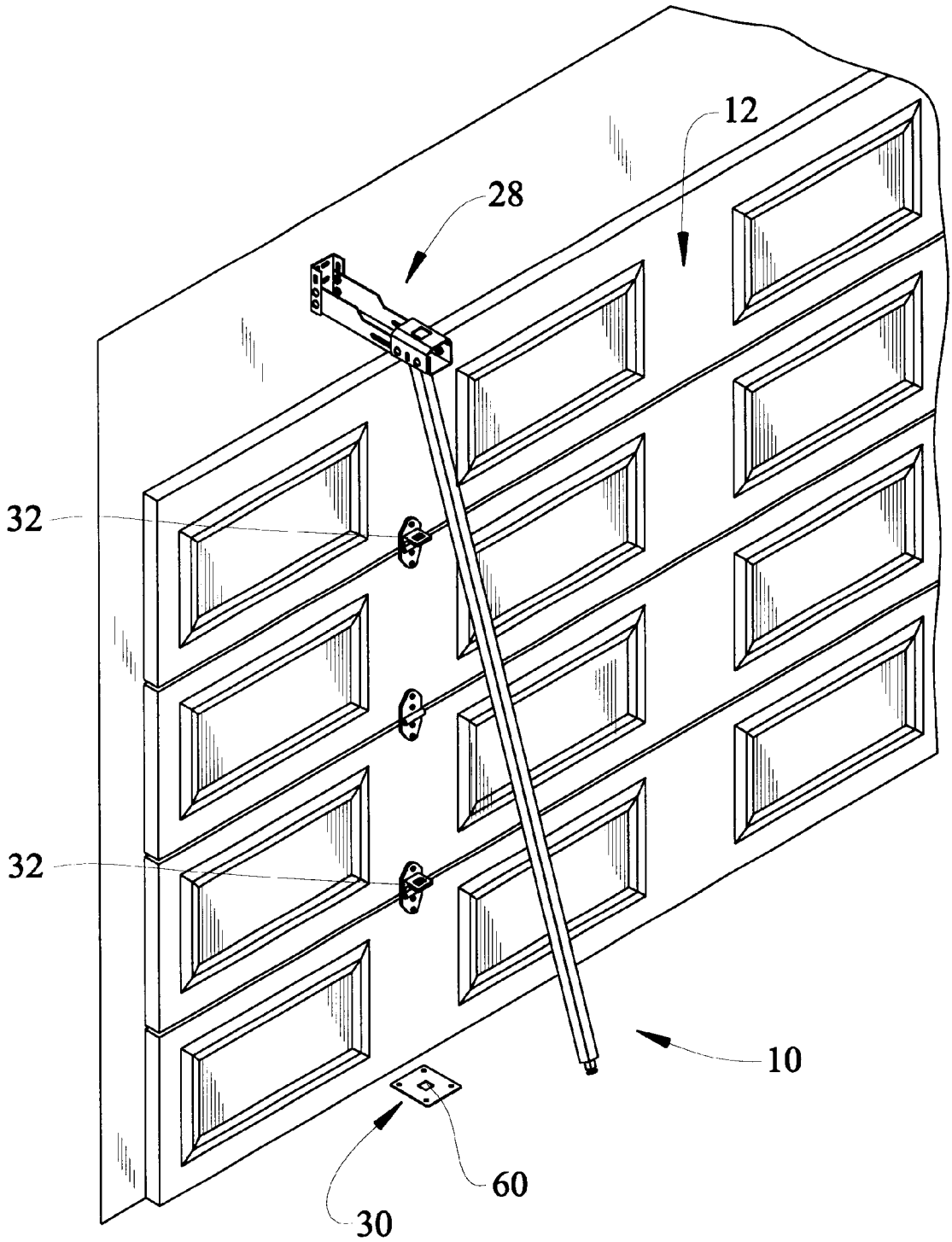
FIG. 5 is a pictorial view of the reinforcement device of the present invention, shown in a partially-engaged orientation.

With additional reference to FIG. 5, the reinforcement device 10 of the present invention is removably installed by inserting the first engagement pin 16 through the pin passthrough slot 52 and into the pin passthrough aperture 50. With the first engagement pin 16 inserted through the pin passthrough aperture 50, the main post first end 20 will abut the top anchor bracket assembly 28. With this arrangement, the main post second end 42 can be aligned with the bottom anchoring plate 30, shown in FIG. 4, and the second engagement pin 18 may be directed into a pin securement aperture 60 disposed therein by lowing the main post 14. As seen with particular reference to FIG. 1, the bottom anchoring plate 30 is secured to the garage floor.

When the main post second end 22 is correctly aligned with respect to the bottom anchoring plate 30, the main post is directed downward so that the post second end 22 comes to rest against the bottom anchoring plate. As the post second end 22 moves toward the bottom anchoring plate 30, the second engagement pin 18 enters the pin securement aperture 60. As the post second end 22 moves toward the bottom anchoring plate 30, the post first end 20 moves downward slightly, and the device enters a securing orientation, in which the first engagement pin 16 is secured by the top anchoring bracket assembly 28, and the second engagement pin 18 is secured by the bottom anchoring plate 30, and as described below, the linking hooks 24 engage the linking plates 32.

Figure 3:
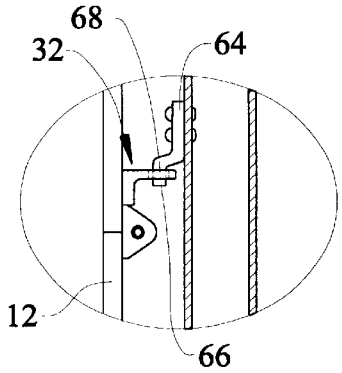
FIG. 3 is a close-up view of the linking means shown in FIG. 1.

As the main post 14 is moves into the above-mentioned securing orientation, linking hooks 24 disposed along a distal sidewall 26 are guided into linking plates 32 disposed along the secured aperture cover 12. As shown in FIG. 3, the linking hooks 24 have a first end 64 attached to the main post distal sidewall 26 and a second end 66 that engages a hook aperture 68 disposed in a corresponding middle anchoring member 32. The linking plates 32 are, in turn, permanently attached to the secured garage door 12. It is noted that the relative positions of the linking hooks 24 and linking plates 32 may be reversed without detriment.

With reference to FIGS. 2 and 4, each of the engagement pins 16,18 includes front and rear bracing notches 70,72 that prevent unwanted vertical movement of the device 10 during use. As the secured aperture cover 12 is subjected to wind loads, the cover may shift forward or backward with respect to the building aperture 34. Positive-pressure wind loads will tend to force the door 12 inward, while negative-pressure wind loads will tend to pull the door outward. In each case, the engagement pins 16,18 will be forced against corresponding front or rear edges 74,76 within the associated pin aperture 50,60. With this arrangement, the engagement pins 16,18 will bind against the corresponding pin aperture 50,60, preventing vertical motion of the device 10 during both positive and negative wind loads. Positive wind loads tend to employ the rear bracing notches 72, while negative wind loads tend to employ the front bracing notches 70.

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

What is claimed is:

1. A reinforcement device for selectively bracing a building aperture cover comprising:

a support post having a first end spaced apart from a second end by a middle portion;

a first end securing means for securing said post first end to a building;

said first end securing means including a first engagement pin having a longitudinal axis extending from said first end of said post and a bracket assembly, said bracket assembly including an upper anchor plate adapted for attachment to an upper boundary surface and at least one rigid member extending from said upper anchor plate, said at least one rigid member having at least one pin aperture adapted to engage said first engagement pin;

first engagement pin includes at least one bracing notch disposed therein, said at least one bracing notch formed as a channel shaped groove normal to said longitudinal axis and being adapted to engage an edge of said at least one pin aperture disposed within said at least one rigid member when said post shifts laterally;

a second end securing means for securing said post second end to said building;

said second end securing means includes a second engagement pin having a longitudinal axis extending from said second end of said post and a lower anchor plate adapted for attachment to a lower boundary surface, said lower anchor plate including at least one pin aperture adapted to engage said second engagement pin;

said second engagement pin includes at least one bracing notch disposed therein, said at least one bracing notch formed as a channel shaped groove normal to said longitudinal axis and being adapted to engage an edge of said at least one pin aperture disposed within said lower anchor plate when said post shifts laterally; and linking means for selectively connecting said post to said aperture cover;

whereby said first securing means, said second securing means, and said linking means are adapted to selectively maintain said post in a securing orientation with respect to said aperture cover and said building and said bracing notches prevent vertical motion of said post when said aperture cover is subjected to a wind load.

2. The reinforcement device according to claim 1, wherein said bracket assembly includes elongated slots in said upper anchor plate for adjustable attachment to said upper boundary surface, a channel shaped first plate extending from said upper anchor plate, and a second plate slidably mounted on said channel shaped first plate, said first channel shaped plate having a pin passthrough slot disposed therein and said second plate having a passthrough aperture therein spaced apart from said pin passthrough slot; said pin passthrough slot and said pin passthrough aperture being adapted to adjustably cooperatively engage said first engagement pin.

3. The reinforcement device according to claim 1, wherein said linking means includes:

at least one linking plate adapted for mounting on said aperture cover; and at least one contoured linking hook disposed on said post middle portion, said at least one linking hook being adapted to selectively engage said at least one linking plate.

4. The reinforcement device according to claim 1, wherein said linking means includes:

at least one linking plate disposed on said post middle portion; and at least one contoured linking hook adapted for mounting on said aperture cover, said at least one linking hook being adapted to selectively engage said at least one linking plate.

* * * * *